US006866483B2

(12) United States Patent
Pol

(10) Patent No.: US 6,866,483 B2
(45) Date of Patent: Mar. 15, 2005

(54) HIGH-PRESSURE CLEANING DEVICE

(75) Inventor: Lanfranco Pol, Belluno (IT)

(73) Assignee: Alfred Kaercher GmbH & Co. KG, Winnenden (DE)

( * ) Notice: Subject to any disclaimer, the term of this patent is extended or adjusted under 35 U.S.C. 154(b) by 0 days.

(21) Appl. No.: 10/422,646

(22) Filed: Apr. 24, 2003

(65) Prior Publication Data

US 2004/0022639 A1 Feb. 5, 2004

Related U.S. Application Data

(63) Continuation of application No. PCT/EP01/12205, filed on Oct. 23, 2001.

(30) Foreign Application Priority Data

Oct. 26, 2000 (DE) ..... 100 53 248

(51) Int. Cl.[7] ..... F04B 35/04

(52) U.S. Cl. ..... 417/43; 417/44.2; 417/44.8; 417/415

(58) Field of Search ..... 417/43, 44.2, 44.8, 417/415, 44.7

(56) References Cited

U.S. PATENT DOCUMENTS 4,675,479 A 6/1987 Wallin
6,062,822 A * 5/2000 Nathan ..... 417/43
6,273,684 B1 * 8/2001 Jensen et al. ..... 417/43
6,745,667 B1 * 6/2004 Dinkel et al. ..... 92/72

FOREIGN PATENT DOCUMENTS

DE 44 04 924 11/1994
DE 295 17 915 4/1997

* cited by examiner

*Primary Examiner*—Charles G. Freay
(74) *Attorney, Agent, or Firm*—Barry R. Lipsitz; Douglas M. McAllister

(57) ABSTRACT

High-pressure cleaning device with an electric motor and a pump for conveying a cleaning fluid, with a plunger, which is displaceable by the cleaning fluid in dependence on its pressure or its flow rate, and with an electric switch, which is actuable by the plunger on its displacement, with electrical leads from the power source and to the windings of the electric motor disposed in the box, with devices attached to the box for fastening the box to the casing of the electric motor and/or pump, characterised in that the switch is disposed in the box, that the walls of the box have openings for the electrical leads, in which outwardly directed contacts are disposed, wherein at least one opening is configured as a multiple plug connection, that the box is fastened via a plug connection to the casing and that the multiple plug connections are disposed on the box in such a manner that at least one matching plug connection fastened to fit on the casing is necessarily connected when the box is fastened to the casing of the electric motor and/or pump.

15 Claims, 1 Drawing Sheet

HIGH-PRESSURE CLEANING DEVICE

The present disclosure relates to the subject matter disclosed in and is a continuation of international application PCT/EP 01/12205 of Oct. 23, 2001, which is incorporated herein by reference in its entirety and for all purposes.

BACKGROUND OF THE INVENTION

The invention relates to a high-pressure cleaning device with an electric motor and a pump for conveying a cleaning fluid, with a plunger, which is displaceable by the cleaning fluid in dependence on its pressure or its flow rate, and with an electric switch, which is actuable by the plunger on its displacement, with electrical leads from the power source and to the windings of the electric motor disposed in the box, with devices attached to the box for fastening the box to the casing of the electric motor and/or pump.

Such a high-pressure cleaning device is known from DE 4404924.

In the case of the prior known high-pressure cleaning device, many working steps are required in the assembly of switch, switch housing, connection box and the casing of the electric motor and/or pump. For example, various individual plugs must firstly be attached to corresponding electrical contact lugs. Screw collar rings and fastening screws must be screwed in place to fasten the switch housing and connection box.

These operations mostly have to be performed manually.

The object and aim of the invention are to configure a high-pressure cleaning device of the above-described type such that a simpler and quicker assembly is possible, which also provides the possibility of automating the respective installation operations.

SUMMARY OF THE INVENTION

This object is achieved with a high-pressure cleaning device of the aforementioned type in that the switch is disposed in the box, that the walls of the box have openings for the electrical leads, in which outwardly directed contacts are disposed, wherein at least one opening is configured as a multiple plug connection, that the box is fastened via a plug connection to the casing and that the multiple plug connections are disposed on the box in such a manner that at least one matching plug connection fastened to fit on the casing is necessarily connected when the box is fastened to the casing of the electric motor and/or pump.

This ensures that during assembly fastening of the box on the casing and the electrical connection on the casing is performed at least partially in one working step. As a result of at least one opening being configured as a multiple plug connection, the electrical fittings can already be assembled as preassembled units, thus resulting in simple installation steps.

It is of particular advantage therein if the matching connection is moulded onto the casing of the electric motor and/or pump. This means that no additional part is required for this matching connection.

A particularly advantageous arrangement results if the matching connection is fastened to the bearing plate of the electric motor at the drive side, since it is then possible to arrange the box in the vicinity of the pump casing.

A particularly simple structure of the high-pressure cleaning device results if the matching connection or connections fastened to fit on the casing of the electric motor and/or pump and the associated plug devices on the box are also configured for fastening the box to the casing of the pump and/or electric motor.

If the at least one matching connection fastened to fit on the casing contains the electrical connection leads for the winding of the electric motor, then no further working steps are required for the connection of individual plug contacts.

A particularly advantageous configuration results if a thermal switch, which contains a bimetallic element with winding current passing through it, is integrated in the box. In this case, it is no longer necessary to provide the electric motor to be installed with a thermal safety switch before assembly and the otherwise necessary steps for connecting the electrical leads on and in the box can be combined with the installation of the thermal switch.

It is particularly advantageous if the bimetallic element is disposed in the housing of the switch. In particular, the switch can be a microswitch.

It is particularly advantageous if the box has openings with outwardly directed contacts for attachment of a capacitor. Assembly may be further simplified if inside the box the electrical leads are constructed in the form of stamped plates and are constructed in one piece with the outwardly directed contacts.

It is particularly advantageous if the box additionally has an opening for a manually operated switching arrangement for the switch.

A particularly simple assembly results if the multiple plug connection on the casing is configured as a connector seat.

A preferred embodiment of the invention is described below on the basis of the drawings.

DETAILED DESCRIPTION OF THE INVENTION

Figure 1:
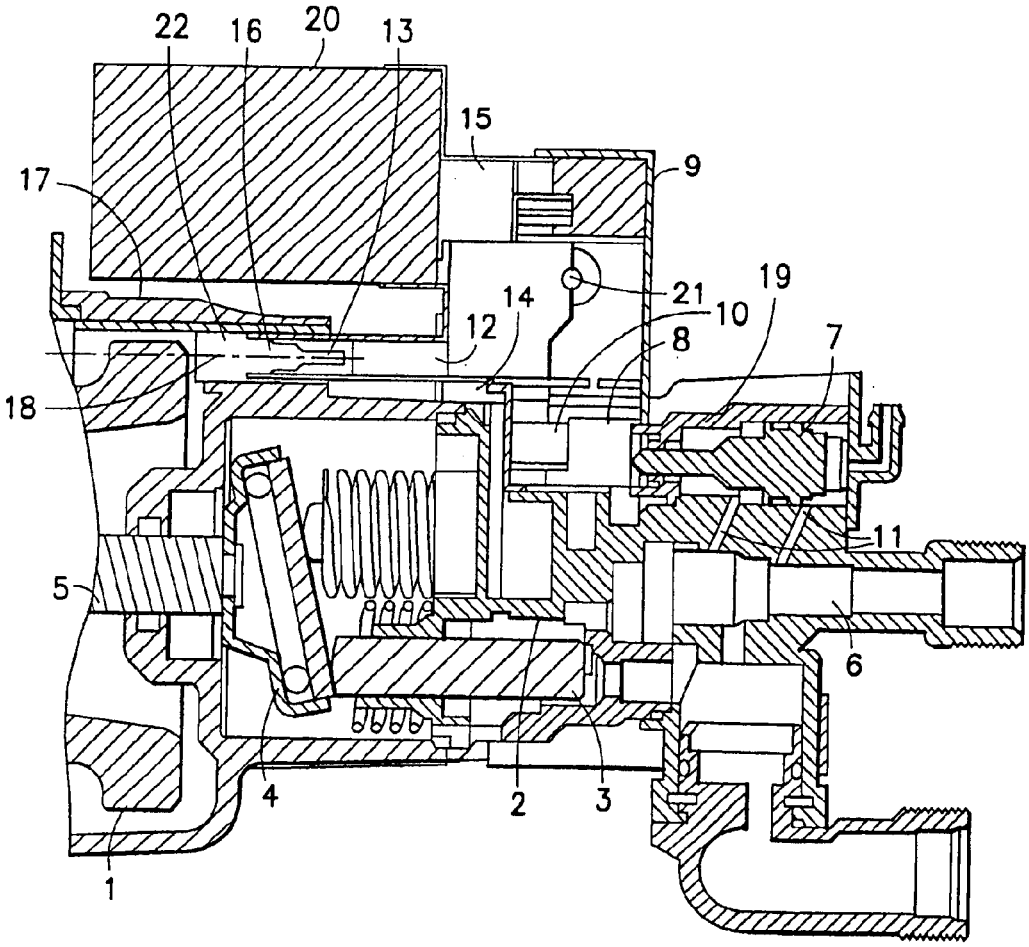
FIG. 1 shows a schematic section of a motor pump unit of a high-pressure cleaning device with the box fastened to the casing of the electric motor and pump.

FIG. 1 shows a partial section through a high-pressure cleaning device with an electric motor 1, which drives a pump 2 for conveying a cleaning fluid. This is an axial plunger pump, the pump plunger 3 of which is moved by a swash plate 4. The swash plate 4 is fastened on the shaft 5 of the electric motor 1 and is set in rotational motion via the shaft 5.

The cleaning fluid flowing through the high-pressure outlet 6 of the pump 2 to a dispensing unit (not shown) for the cleaning fluid acts on the plunger 7, which is displaced in its longitudinal direction as a result. The plunger 7 acts on the microswitch 10 disposed in the box 9 via an operating element 8 and operates this microswitch 10 in dependence on the pressure of the cleaning fluid. The plunger is a differential pressure plunger, which is connected to the high-pressure outlet of the pump by the holes 11.

Electrical leads 12 in the form of stamped plates are disposed in the box. Openings 13, 14, 15 are provided in the walls of the box 9 for the electrical leads. Outwardly directed contacts in the form of multiple plug connections 16 are provided in these openings 13, 14, 15.

The bearing plate 17 of the electric motor 1 on the drive side is configured as a seat for the swash plate 4. An opening 22, the edges of which serve to hold the box 9, is moulded onto the bearing plate 17 on the output side. A plug is moulded on the box 9 at the appropriate location. Inserted into the opening 22 on the bearing plate 17 of the electric motor 1 on the output side is a multiple plug connection 18, from which leads are directed to the winding of the electric motor. During assembly, the box 9 is attached to the multiple plug connection 18 and the part of the plug connection 22 on the casing side and fastened during subsequent installation of the pump casing 19. In this case, the box is held via an additional lug moulded on the pump casing 19 which engages into the corresponding opening in the box wall. This results in a particularly secure fastening of the box on the casing without any additional screw connections or similar more complex fastening devices being required.

From the matching connection 18 electrical connection leads lead to the winding of the electric motor 1. Moreover, a capacitor 20 is attached to the box via a multiple plug contact 15. The box 9 additionally has an opening 21 for a manually operated switching arrangement 22 for the switch 10.

The electric motor 1 is switched on and off in dependence on the pressure or flow rate with the switch 10 via the plunger 7 or by manual operation. The arrangement is advantageously selected in such a manner that the manual operation during switch off simultaneously prevents the plunger 7 from acting on the switch 10 so that, when switched off by manual operation, the high pressure cleaning device can no longer be switched on again by unintentional pressure build-up or unintentional opening of the spray gun.

For this, the manual operation moves the entire switch 10 beyond the range of influence of the plunger 7.

What is claimed is:

1. A high-pressure cleaning device comprising:

an electric motor coupled to a pump for conveying a cleaning fluid;

a plunger displaceable by at least one of a cleaning fluid pressure and a cleaning fluid flow rate;

an electric switch disposed in a box being actuatable by a displacement of said plunger;

said electric switch being coupled from a power source to windings of said electric motor through electrical leads disposed in said box and said box being fastened to at least one of an electric motor casing and a pump casing;

at least one opening formed in walls of said box configured to receive said electrical leads;

outwardly directed contacts configured as a multiple plug connection disposed in said at least one opening; and at least one matching plug connection fastened to the other of said electric motor casing and pump casing, wherein said multiple plug connection is configured to mate with said at least one matching plug connection when said box is fastened to said at least one of said electric motor casing and pump casing.

2. The high-pressure cleaning device according to claim 1, wherein said at least one matching plug connection is molded onto the casing of at least one of said electric motor easing and said pump casing.

3. The high-pressure cleaning device according to claim 1, wherein said matching connection is fastened at a drive side of a bearing plate of said electric motor.

4. The high-pressure cleaning device according to claim 1, wherein said at least one matching plug connection and each associated said multiple plug connections on said box are configured to fasten said box to at least one of said electric motor casing and said pump casing.

5. The high-pressure cleaning device according to claim 4, wherein said at least one matching plug connection contains said electrical leads for said winding of said electric motor.

6. The high-pressure cleaning device according to claim 5, wherein inside said box said electrical leads are constructed in the form of stamped plates and are constructed in one piece with said outwardly directed contacts.

7. The high-pressure cleaning device according to claim 4, wherein inside said box said electrical leads are constructed in the form of stamped plates and are constructed in one piece with said outwardly directed contacts.

8. The high-pressure cleaning device according to claim 1, wherein inside said box said electrical leads are constructed in the form of stamped plates and are constructed in one piece with said outwardly directed contacts.

9. The high-pressure cleaning device according to claim 1, wherein said box additionally has an opening for a manually operated switching arrangement for the switch.

10. The high-pressure cleaning device according to claim 1, wherein said multiple plug connection on at least one of said electric motor casing and said pump casing is configured as a connector seat.

11. The high-pressure cleaning device according to claim 1, wherein a part of said at least one matching plug connection between said box and said at least one of said electric motor casing and said pump casing on a casing side is molded onto at least one of said electric motor casing and said pump casing.

12. The high-pressure cleaning device according to claim 1, wherein a part of said at least one matching plug connection between said box and said at least one of said electric motor casing and said pump casing on a casing side is molded onto a bearing plate on a drive side of said electric motor.

13. The high-pressure cleaning device according to claim 1, wherein said box includes openings with outwardly directed contacts for attachment of a capacitor.

14. The high-pressure cleaning device according to claim 1, wherein said at least one matching plug connection contains said electrical leads for said winding of said electric motor.

15. The high-pressure cleaning device according to claim 14, wherein inside said box said electrical leads are constructed in the form of stamped plates and are constructed in one piece with said outwardly directed contacts.

* * * * *